US006095614A

United States Patent [19]

Canna et al.

[11] Patent Number: 6,095,614

[45] Date of Patent: Aug. 1, 2000

[54] CHILD CARRIER HARNESS

[75] Inventors: John S. Canna, Orchard Park; Julia M. Wilkins, Buffalo; Kenneth VonFelten, Marietta, all of N.Y.

[73] Assignee: Mattel, Inc., El Segundo, Calif.

[21] Appl. No.: 09/123,355

[22] Filed: Jul. 28, 1998

[51] Int. Cl.[7] ..... B60R 21/00

[52] U.S. Cl. ..... 297/468; 297/467; 297/485; 297/288.13; 5/655

[58] Field of Search ..... 297/219.12, 219.1, 297/228.12, 228.13, 250.1, 256.15, 467, 468, 474, 485, 487, 488, DIG. 11; 5/665, 628

[56] References Cited

U.S. PATENT DOCUMENTS

| | | | |
|---|---|---|---|
| 944,020 | 12/1909 | De Camp . | |
| 2,495,482 | 1/1950 | Rogatz | 297/467 |
| 2,739,642 | 3/1956 | Reidell | 297/485 |
| 2,741,412 | 4/1956 | Hinkle . | |
| 3,713,692 | 1/1973 | McCracken et al. . | |
| 3,992,057 | 11/1976 | Studebaker | 297/467 |
| 4,050,737 | 9/1977 | Jordan | 297/389 |
| 4,188,065 | 2/1980 | Meeker . | |
| 4,190,287 | 2/1980 | Lemisch et al. | 297/467 X |
| 4,568,125 | 2/1986 | Sckolnik | 297/467 |
| 4,650,252 | 3/1987 | Kassai . | |
| 4,834,459 | 5/1989 | Leach . | |
| 4,834,460 | 5/1989 | Herwig . | |
| 4,861,109 | 8/1989 | Leach . | |
| 4,871,210 | 10/1989 | Alexander et al. . | |
| 4,998,307 | 3/1991 | Cone . | |
| 5,056,869 | 10/1991 | Morrison | 297/485 |
| 5,082,325 | 1/1992 | Sedlack | 297/250 |
| 5,092,004 | 3/1992 | Cone et al. . | |
| 5,178,309 | 1/1993 | Bicheler et al. . | |
| 5,205,450 | 4/1993 | Derosier | 224/161 |
| 5,626,397 | 5/1997 | Reid . | |
| 5,868,465 | 2/1999 | Kvalvik | 297/228.13 X |
| 5,915,789 | 6/1999 | Ponce De Leon, III | 297/485 X |

FOREIGN PATENT DOCUMENTS

| | | |
|---|---|---|
| 961460 | 1/1975 | Canada . |
| 0 355 950 A1 | 2/1990 | European Pat. Off. . |
| 1519793 | 8/1976 | United Kingdom . |
| WO 91/12978 | 9/1991 | WIPO . |

OTHER PUBLICATIONS

PCT International Search Report, Application No. PCT/US99/16624, Oct. 22, 1999.

*Primary Examiner*—Laurie K. Cranmer
*Attorney, Agent, or Firm*—Morgan, Lewis & Bockius LLP

[57] ABSTRACT

A child carrier harness includes a first harness member made of soft goods with a pair of male fasteners receivable with a second pair of female fasteners secured to the ends of an adjustable strap secured to the rear face of the seatback. The harness also includes an adjustable strap disposed on the rear face of the seatback for adjusting the length of the strap and thereby adjusting the harness to accomodate different mid-section sizes.

21 Claims, 8 Drawing Sheets

CHILD CARRIER HARNESS

BACKGROUND OF THE INVENTION

1. Field of the Invention

This invention relates to a harness and, more particularly, to a restraint harness for a child carrier.

2. Description of the Related Art

Restraint harnesses for children are generally known in the art. In particular, harnesses which restrain about a midsection are known and are often used in conjunction with child carriers to restrain a child during transport or otherwise for providing a means for securely retaining a child in a seat.

U.S. Pat. No. 4,188,065 to Meeker discloses a combination harness and coverlet for infant seats. Meeker's harness consists of a front portion with restraining midriff straps in contact with the seat occupant and side strap portions releasable secured by fasteners positioned on the rear face of the child seat. Meeker's harness suffers from the drawback that the parent must reach behind the seat to disengage the harness and requires one to remove the entire harness when a portion becomes soiled from use. Thus, Meeker's harness does not provide a convenient means for disengaging the harness and requires the entire harness assembly to be removed when a parent wishes to remove the portion of the harness in contact with the child.

U.S. Pat. No. 5,626,397 to Reid discloses an adult restraint harness consisting of an elongated body panel and lower torso panel with adjustable straps secured at the rear of the seat. Like Meeker, Reid suffers from the drawback that one has to reach behind the seat to disengage the harness and thus does not provide a convenient means for disengaging/engaging the harness nor providing the convenience of removing only that portion of the harness which comes into contact with a seat occupant.

Known harness restraints suffer from two additional disadvantages related to the operation and location of the harness adjustment. First, when a harness adjustment is located on the front, or seating side of the seat, a child is apt to tamper with the adjustment, thereby loosening the harness and allowing the child to escape. Secondly, harnesses that use threaded webbing fasteners to adjust a harness size can easily be improperly re-threaded when, for example, a parent removes and then re-attaches soft goods to the seat.

SUMMARY OF THE INVENTION

A child harness preferably includes both a means for adjusting the harness for various waist (or midsection) sizes while at the same time providing a comfortable seating/lying area that is relatively free of strap adjustment buckles or other obstructing harness restraint members, which cause discomfort for the child, especially when the child moves about in the child carrier. It is also preferred to have a harness which is separable: a portion in contact with the child and a portion fixed to the support structure. This feature offers the advantage of allowing a parent to conveniently attach/remove the portion of the harness in contact with the child (e.g., for purposes of washing a soiled seating surface) without having to disconnect the entire harness. Finally, it is desirable to have a convenient means for securing and disengaging the harness by providing, for example, fasteners accessible from the front face of the supporting surface. Known harnesses, however, will typically contain one of the above features, but not all of the above features. Thus, there is a need for a harness which offers all of the above advantages of convenience and yet provides a comfortable seating/lying area for the child.

The invention is generally directed to an child restraint harness which substantially obviates all of the limitations of the prior art in child harness restraints.

An aspect of the invention is directed to a harness including a supporting member attached to the portion of the supporting surface that comes into contact with the child occupant and a securing member fixed to the rear face of the supporting surface.

In another aspect of the invention, a fastening means for the harness is accessible from the front face of the supporting surface and the adjustment means for the harness is positioned on the rear face of the supporting surface. By providing the adjustment means on the rear face of the supporting surface and yet making the harness fasteners accessible from the front face of the supporting surface, the harness is both conveniently accessible and provides a comfortable seating or sleeping area for the child. In addition, by placing the adjustment means on the rear face, the child cannot tamper with the adjustment. Furthermore, it is expected that by placing the adjustment portion of the harness on the rear face, there will be little, if any, inconvenience since a parent will usually only need to adjust the harness once and will thereafter only require access to the fasteners.

In another aspect of the invention, fastening ends of the portion of the harness fixed to the rear face are shortened or lengthened to adjust the waist size of the harness, thus providing an inexpensive, safe and effective means for adjusting a harness. The adjustment means for the harness avoids the drawbacks of harnesses which use webbing threaded through buckles to secure and adjust harnesses. For most harnesses, if the webbing is not properly threaded through the buckle, the loaded webbing can slip. The present harness overcomes this problem by providing a harness adjustment which does not use a webbing threaded through a buckle. Furthermore, by placing the harness adjustment on the rear face of the supporting surface, a child cannot tamper with the harness adjustment.

Additional features and advantages of the invention will be set forth in the following description, and in part will be apparent from the description, or may be learned by practice of the invention. The objectives and other advantages of the invention will be realized and attained by the structure particularly pointed out in the written description and claims as well as the appended drawings.

To achieve these and other advantages, and in accordance with the purposes of the present invention, as embodied and broadly described, the invention concerns a harness restraint adaptable for use in a child carrier that includes a supporting surface with front and rear faces. The present invention includes: first and second harness members, the first member being releasably attachable to the front face of the supporting surface, the second member being fixedly secured to the rear face; the first and second members are releasably attachable to each other by fasteners disposed on the front face and the harness size is adjusted by an adjustment means disposed on the rear face; and the harness features an adjustment means that includes shortening the lengths of the fastening ends of the second member.

It is to be understood that both the foregoing general description and the following detailed description are exemplary and explanatory and are intended to provide further explanation without limiting the scope of the invention as claimed.

BRIEF DESCRIPTION OF THE DRAWINGS

The accompanying drawings, which are included to provide a further understanding of the invention, are incorporated in and constitute a part of this specification, illustrate embodiments of the invention and together with the description serve to explain the principles of the invention. In the drawings.

DETAILED DESCRIPTION OF THE PREFERRED EMBODIMENT

Reference will now be made in detail to preferred embodiments of the present invention, examples of which are illustrated in the accompanying drawings.

Figure 1A:
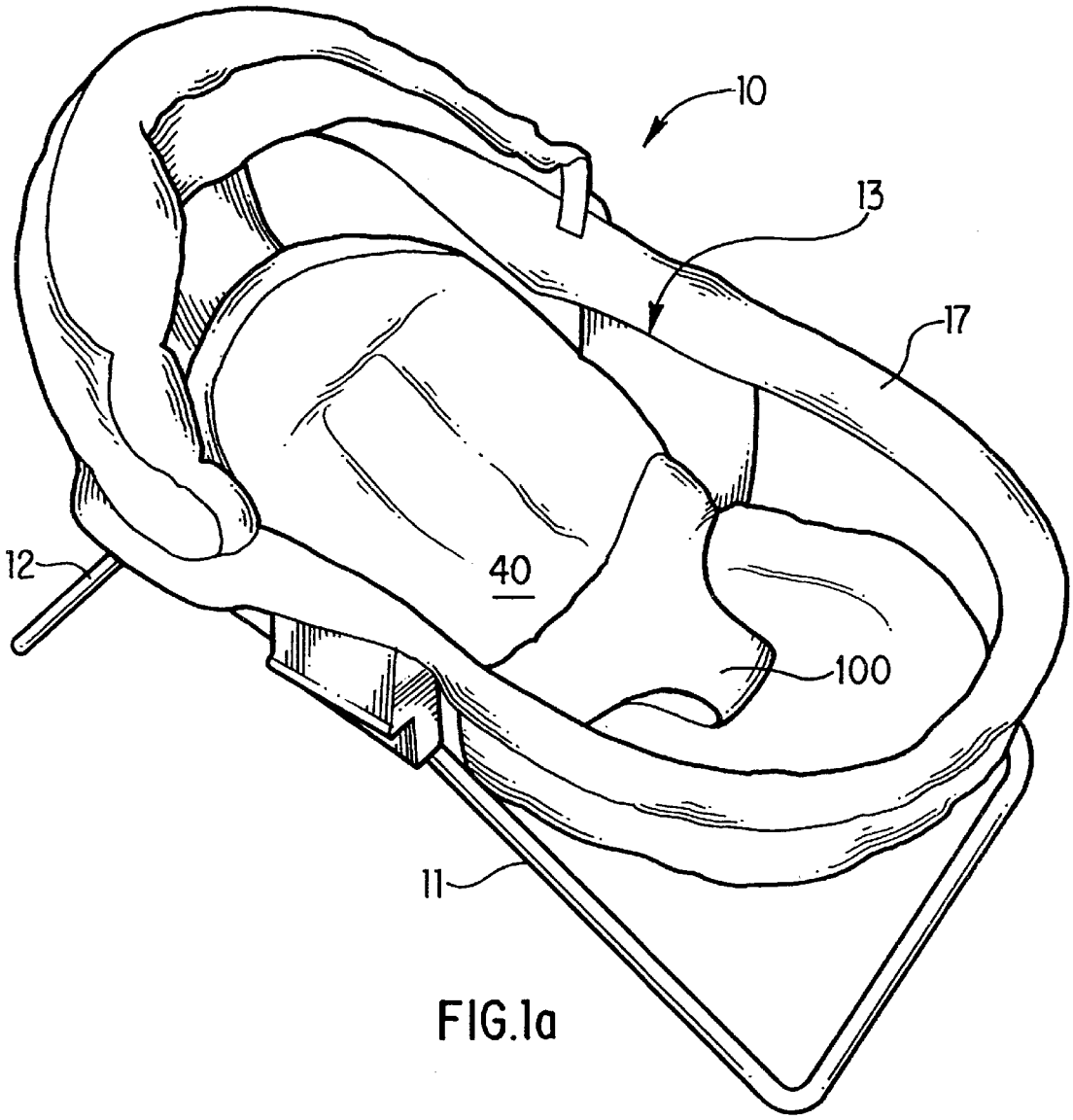
FIG. 1*a* is an isometric view of a child carrier.

In a preferred embodiment of the present invention, a harness is used in connection with a child's bassinet, as shown generally in FIG. 1*a*. Reference will be made to this particular embodiment of the invention with the understanding that the restraint harness of the present invention is by no means limited to use in a child's bassinet. The invention is readily adaptable for restraining/securing a child on any similar supporting surface, such as supporting surfaces of strollers or bouncer seats.

Reference will now be made in detail to this presently preferred embodiment of the restraint harness, examples of which are illustrated in the accompanying drawings. As shown in FIG. 1*a*, the bassinet generally includes a foldable frame 10 including front and rear legs 11, 12, and a rim 17. A supporting surface 15 for the child may be used as either a seating surface (as shown FIG. 1*b*) or reclined for use as a sleeping surface (not shown). A removable pad 40 (as shown in FIG. 1*a* and removed in FIG. 1*b*) is placed on the supporting surface 15. The child is then placed on the pad 40 and secured in place by a restraint harness 100.

Figure 3:
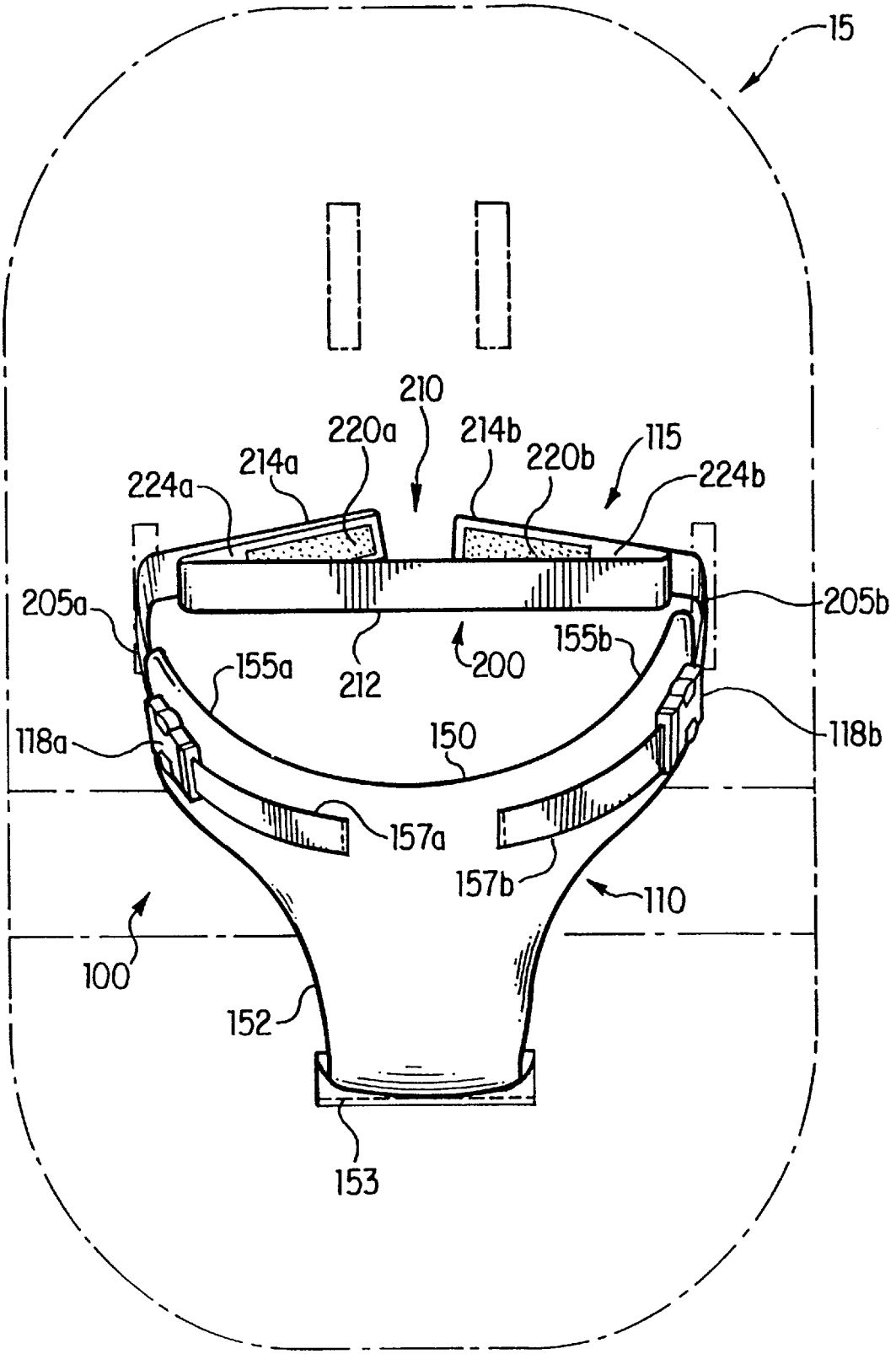
FIG. 3 is a frontal view of the harness of FIG. 1*a*.
Figure 10:
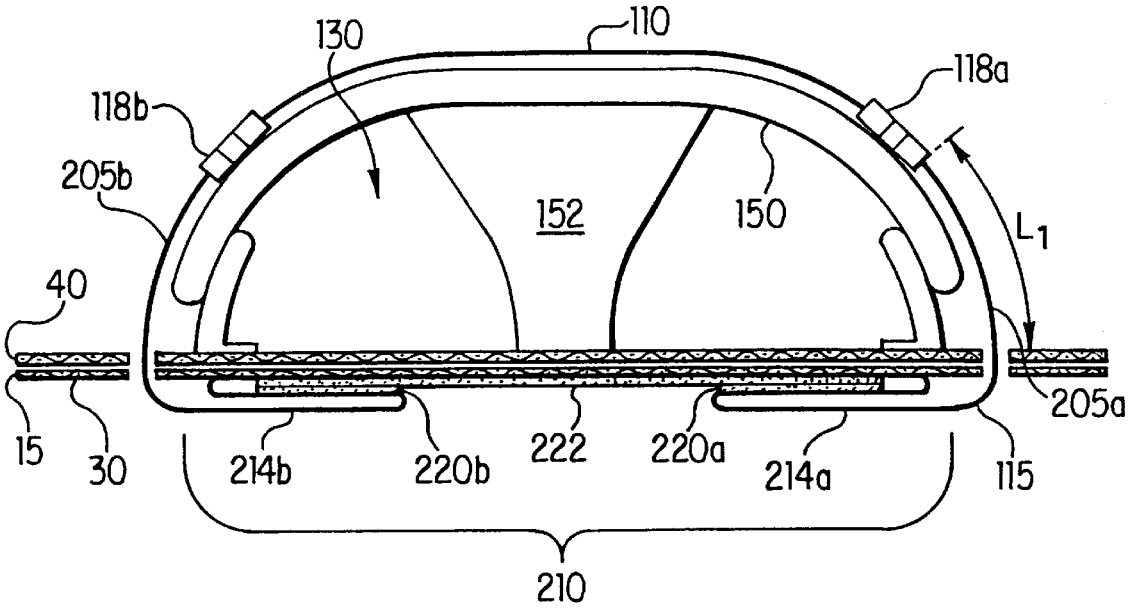
FIG. 10 is a cross-sectional view taken along line 10—10 in FIG. 2.
Figure 11:
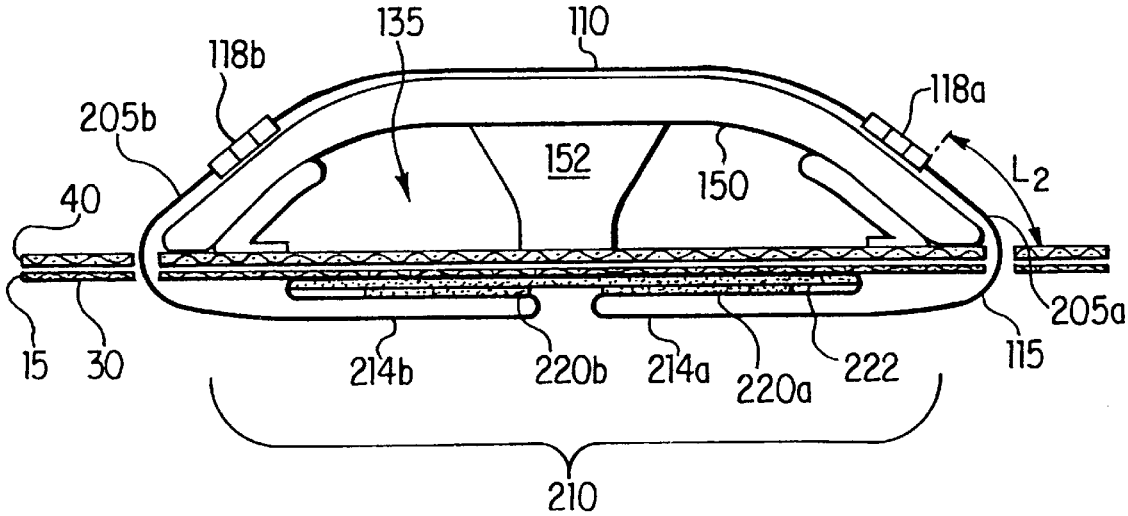
FIG. 11 is a cross-sectional view taken along line 11—11 in FIG. 2.

The restraint harness 100 includes a supporting member 110 and securing member 115 (as shown in FIGS. 3, 10–11). Supporting member 110 and securing member 115 are releasably coupled by buckle-type fasteners 118*a*, 118*b*. The supporting member 110 is disposed on the front face of the supporting surface 15 while the securing member 115 is secured to the rear face of the supporting surface 15 (as shown in FIGS. 3, 10 and 11). The securing member 115 includes an adjustment means for adjusting the harness size (as shown in FIGS. 3, 5, 10 and 11).

The preferred structure of the child carrier 10 providing the relevant supporting structure for the removable pad 40 and the restraint harness 100 will now be described with particular reference to FIGS. 1*b*, 8 and 9.

Figure 1B:
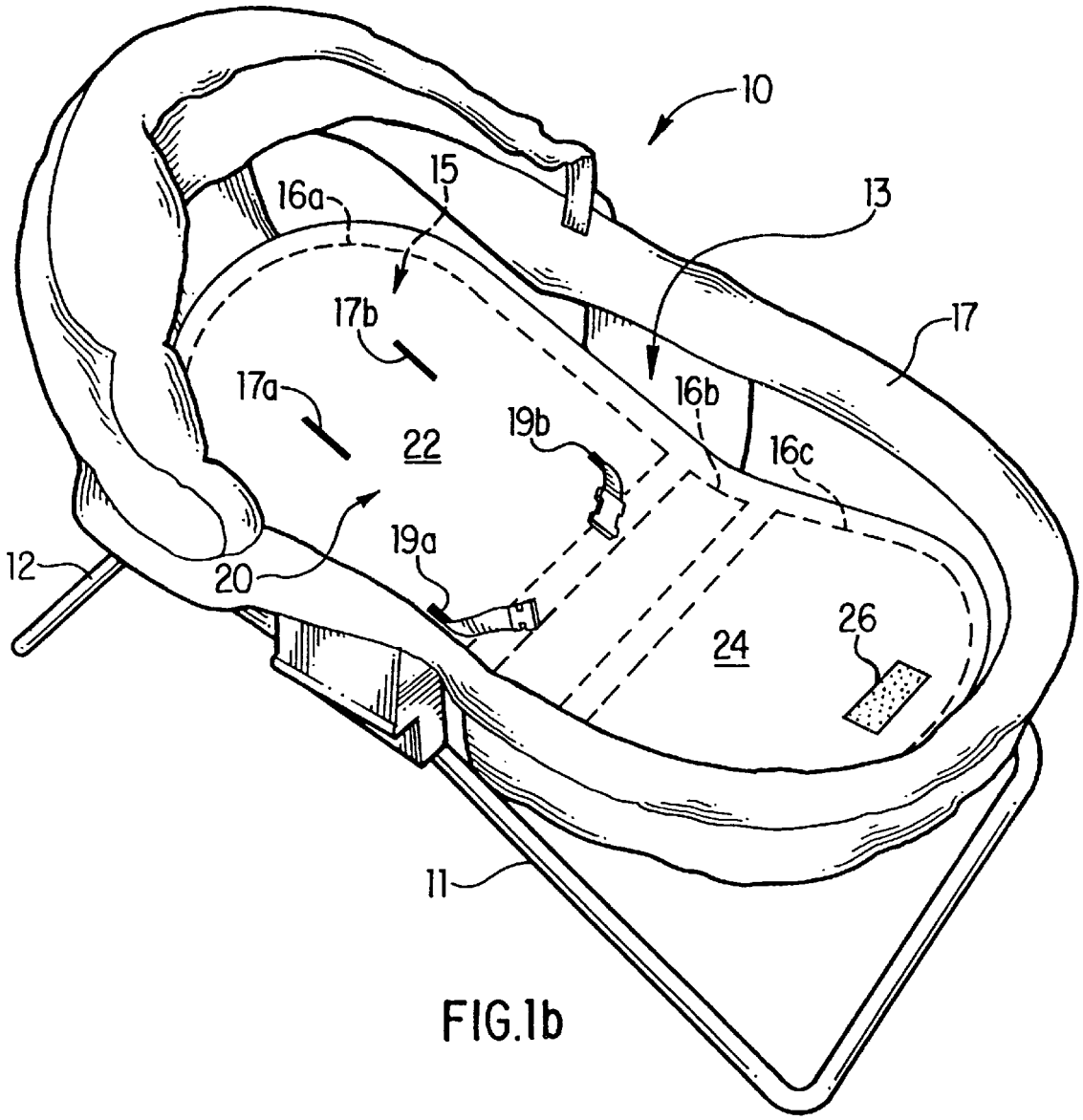
FIG. 1*b* is an isometric view of the child carrier of FIG. 1*b* with a soft goods pad removed.

Referring to FIG. 1*b*, the bassinet includes a bassinet shell 13 supported from the rim 17. FIGS. 8 and 9 show a supporting surface 15 portion of the bassinet shell 13 that has a generally elliptical shape. The dimensions of the supporting surface 15 relate to the surface area provided for the child. The supporting surface 15 includes upper, middle, and lower battens 16*a*, 16*b*, and 16*c*, respectively, inserted into fabric sleeves. The supporting surface 15 uses the three battens 16*a*, 16*b*, 16*c* coupled together by fabric sleeves to provide a surface that is reconfigurable between a seating and sleeping surface for a child.

For purposes of describing the various aspects of the presently preferred embodiment relating to the present invention, there are no differences between the child carrier 10 with supporting surface 15 configured as a seating or sleeping surface. Therefore, reference will hereafter primarily be made towards a supporting surface 15 configured as a seat with the understanding that the description is sufficient to enable one to practice the invention for a harness used to restrain a child on a sleeping surface.

Figure 8:
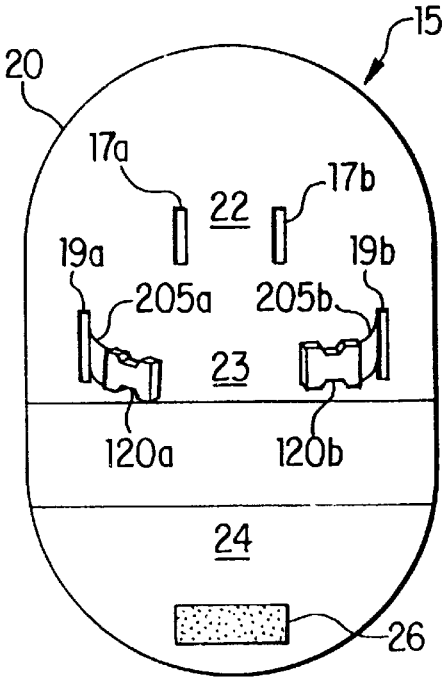
FIGS. 8 and 9 are front and rear faces, respectively, of the supporting surface in FIG. 1*b*.
Figure 9:
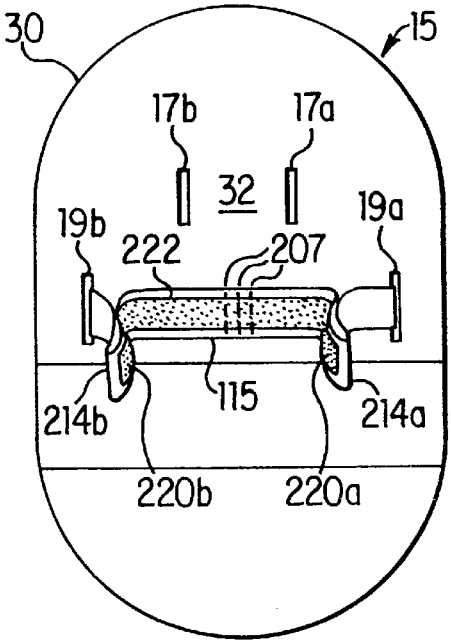

Referring to FIGS. 8 and 9, the supporting surface 15 includes a front face 20 and rear face 30. The front face 20 refers to the seating side of the supporting surface 15, which receives the removable pad 40 (as discussed below). The rear face 30 refers to the side of the supporting surface 15 opposite the seating side. The front face 20 of the supporting surface 15 provides a back support 22, midsection support 23, and lower leg support 24 for a child placed in the seat. The upper portion 32 of the rear face 30 is opposite the back support 22 and midsection support 23 portions of the front face 20. A pair of left and right rectangularly shaped apertures, 17*a* and 17*b*, respectively, are located centrally on the back support 22 of the front face. Disposed on the lower leg support 24 portion of the front face 20 is one of a loop and hook fastener 26. As discussed below, the apertures 17*a* and 17*b* and first fastener 26 are used to attach the upper and lower portions, respectively, of the removable pad 40 to the back support 22 and lower leg support 24 portions of the front face 20 of the supporting surface 15. A pair of rectangularly shaped harness strap apertures 19*a*, 19*b*, respectively, are located at the midsection support 23 portion of the front face 20 for providing a passageway for the fastening ends 205*a*, 205*b* of the securing member 115 of the harness (as discussed below). The spaced relationship of apertures 19*a*, 19*b* correlates generally to a typical waist size of a child.

In the preferred embodiment of the child carrier 10, a removable pad 40 is removably attached to the front face 20 of the supporting surface 15. This removable pad 40 will now be described with reference to FIGS. 4, 6, 7.

Figure 2:
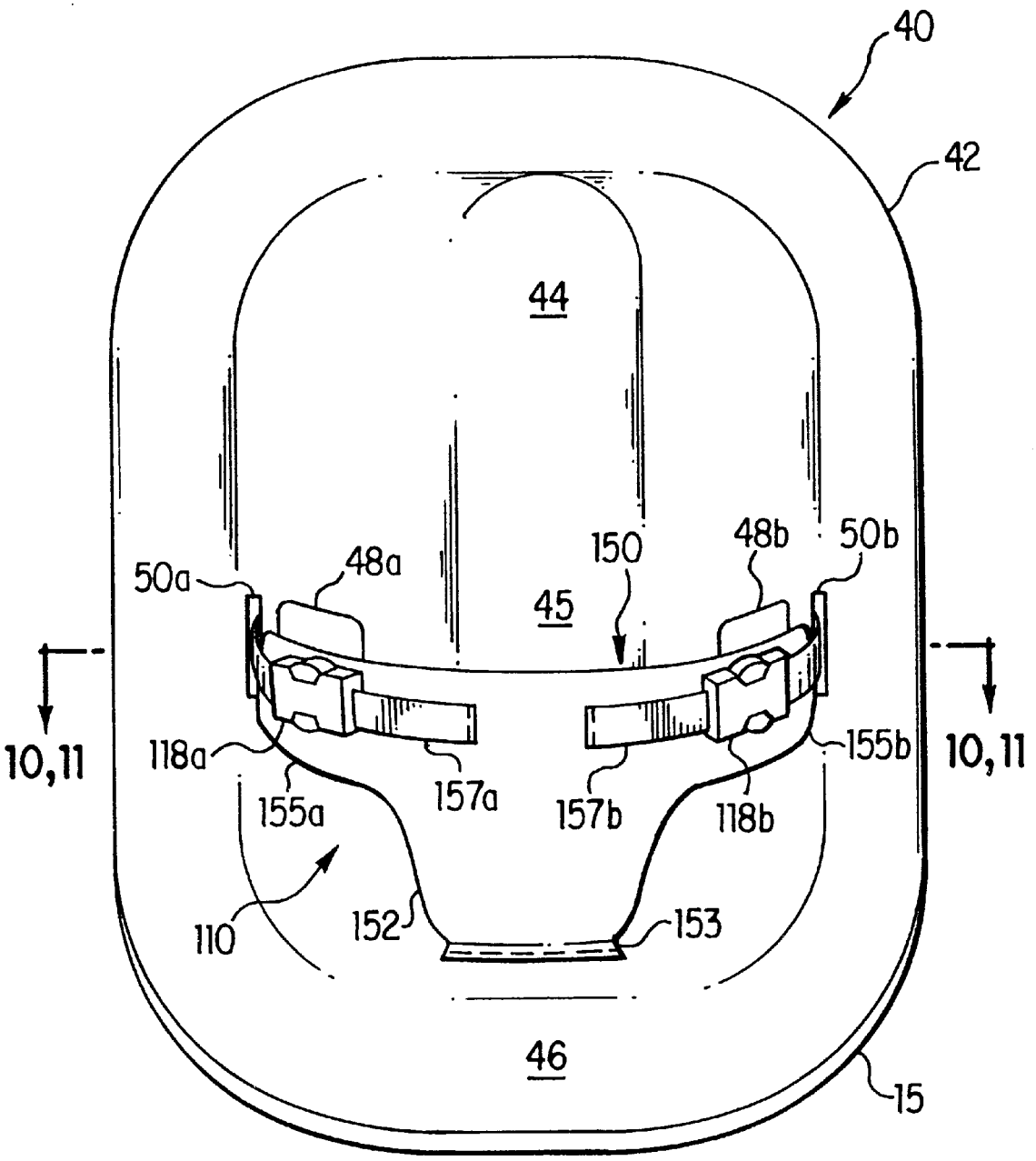
FIG. 2 is a frontal view of the supporting surface of the child carrier in FIG. 1*a*.
Figure 4:
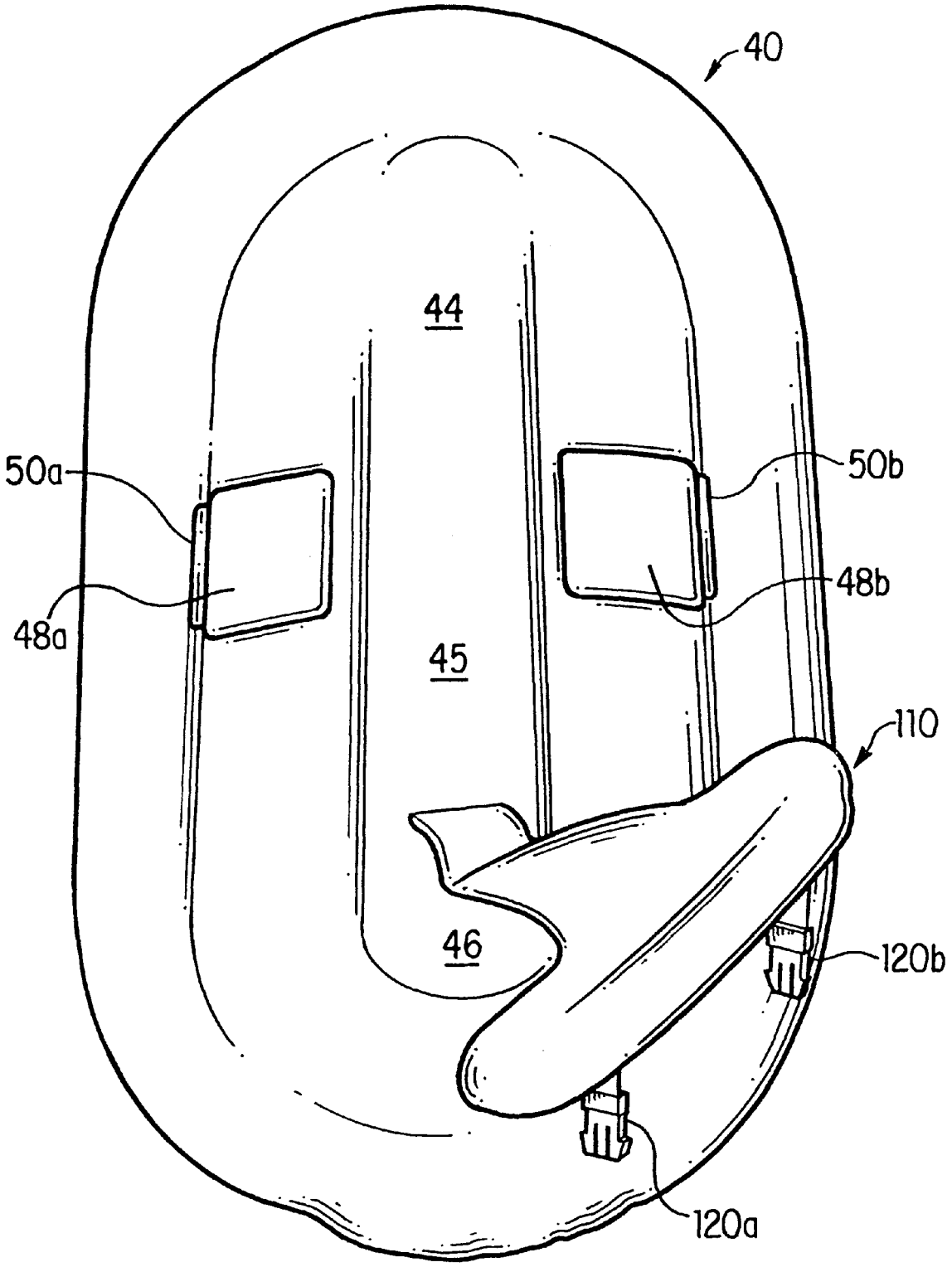
FIG. 4 is a frontal view of the pad of FIG. 1*a*.

Referring to FIG. 4, the removable pad 40 is of a generally elliptical shape corresponding to the shape of the supporting surface 15 described above. Preferably, this removable pad 40 covers the entire surface of the front face 20 (as shown in FIG. 2). The removable pad 40 is made of a soft, padded fabric material for providing a comfortable seating surface for the child. The pad 40 is easily removable from the supporting surface 15 by disengaging upper and lower fasteners (as described below) for purposes of, for example, washing the pad 40 when it becomes soiled from use.

Figure 6:
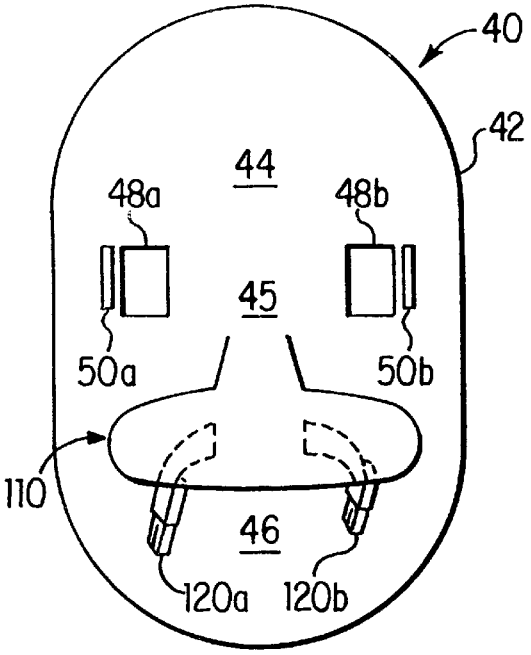
FIGS. 6 and 7 are front and rear faces, respectively, of the pad of the child carrier in FIG. 1*a*.
Figure 7:
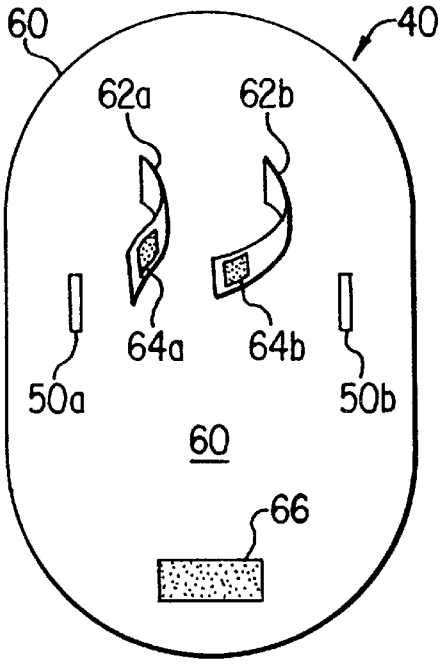

Referring to FIGS. 6 and 7, the pad 40 includes a front face 42 and rear face 60, respectively. The front face 42 refers to the side of the pad 40 in contact with the child occupant whereas the rear face 60 refers to the side opposite the front face 40 which is in contact with the front face 20 of the supporting surface 15. The front face 42 includes a back portion 44, midsection portion 45, and lower leg portion 46, which generally correspond to the surfaces in contact with the back, midsection and lower legs of the child. The pad 40 is removably attached to the supporting surface 15 by means of a pair of fastening straps 62*a* and 62*b,* disposed on the upper portion of the rear face 60, and by a second portion of a hook and loop fastener 66 disposed on the lower portion of the rear face 60. That is, the pad 40 is secured at the back portion 44 to the supporting surface 15 by feeding the right and left fastening straps 62*b* and 62*a* through the right and left apertures 17*a* and 17*b,* respectively, of the supporting surface 15 and then fastening each end by way of a hook and loop fastener, 64*a* and 64*b.* The lower leg portion 46 of the pad 40 is secured to the lower leg portion 24 of the supporting surface 15 by fastening the one of the hook and loop fastener 66 to the other of the hook and loop fastener 26. A second pair of right and left apertures 50*a* and 50*b,* respectively, are located on the midsection portion 45 of the pad 40 and are positioned to align with the apertures 19*a* and 19*b,* respectively, of the supporting surface 15 to provide a passageway for the fastening ends 205*a* and 205*b,* respectively, of the harness securing member 115. The apertures 50*a,* 50*b* are oversized so that the fastening ends 205*a,* 205*b* of the securing member 115 can be easily pulled through or fed into the apertures 50*a,* 50*b* when the pad 40 is removed or attached, respectively to the supporting surface 15.

A pair of padded flaps, 48*a* and 48*b,* are stitched to the pad 40 and positioned adjacent to the apertures 50*a,* 50*b* to provide a padded surface between the child's midsection and the fastening ends 205*a* and 205*b* of the securing member 115 (as shown in FIGS. 2, 10–11). Referring to FIGS. 2 and 6, the supporting member 110 of the harness 100 is fixedly secured at the intersection of the midsection portion 45 and lower leg portion 46 of the pad 40.

The harness of the presently preferred embodiment will now be further described with reference to FIGS. 2, 3, 5, and 10–11.

The harness 100 includes a supporting member 110 removably attached to the front face 20 of the supporting surface 15 and a securing member 115 fixed to the rear face 30 of the supporting surface 15. In this preferred embodiment, the supporting member 110 is fixedly secured to the pad 40. Pad 40 is removably attached to the front face 20 of the supporting surface 15 by means of fasteners 62*a,* 62*b,* and 26, 66 (as described above). The supporting member 110 and securing member 115 of the harness of the present invention are shown in FIG. 3 (which shows the harness in relation to the supporting surface 15, shown in phantom). The supporting and securing members 110, 115 are coupled together by a pair of buckle fasteners 118*a,* 118*b* disposed on the front face 20 and the securing member 115 includes a harness adjustment means (see FIGS. 10 and 11) disposed on the rear face 30. The harness may be adjusted between at least a first harness size 130 and a second harness size 135 by increasing and decreasing the length of the fastening ends 205*a* and 205*b,* respectively, of the securing member 115 (as shown in FIGS. 10 and 11).

The supporting member 110 of the presently preferred embodiment will now be further described in with reference to FIGS. 2, 3, 10 and 11.

Referring to FIGS. 2, the supporting member 110 of the harness 100 is disposed entirely on the seating side of the supporting surface 15, providing a restraint at the child's midsection. The supporting member 110 includes an upper end 150, positioned to lie adjacent the child's waistline, integral with a lower tapered end 152. The supporting member 110 is fastened to the front surface 42 of removable pad 40 by stitching 153 at the juncture between the midsection portion 45 and lower leg portion 46 of the pad 40.

The shape of supporting member 110 may take on a variety of forms without departing from the scope of the invention. It is understood, therefore, that the preferred upper and lower parts 150, 152, of the supporting member (as described in more detail, below) illustrate only one possible use of the invention, namely a harness which acts both as a waist and crotch restraint. It is understood that the invention may also be practiced by a supporting member that, for example, restrains only at the waistline of a child or by a support member which includes a shoulder restraint in a addition to a midsection restraint.

The upper end 150 is generally of a rectangular shape and of a length sufficient to cover a substantial portion of the waistline of the child restrained in the harness (as can be seen in FIGS. 10–11). The upper end includes right and left wings 155*a,* 155*b.* The lower end 152, providing a crotch restraint, is tapered to provide a passageway for the child's lower legs, which rest on the lower leg portion 46 of the pad 40. The upper end 150 and lower end 152 are made of a soft, padded fabric material, preferably the same material as the removable pad 40.

A pair of right and left straps 157*a* and 157*b,* respectively, are stitched at first ends to the outer surface of the upper part 150 (i.e., that part not in contact with the child, as can be seen in FIG. 10) and includes a pair of male fasteners 120*a* and 120*b* secured to the second ends for engagement with a corresponding pair of female fasteners 124*a* and 124*b* of the securing member 115. The positioning of the fasteners 118*a,* 118*b,* formed by the joining of 120*a* and 124*a,* and 120*b* and 124*b,* on the outer surface portion of the upper end 150 provides a convenient means for releasably securing the child in the harness. The upper part 150 includes right and left wings 155*a,* 155*b* for providing a padding between fasteners 118*a,* 118*b* and straps 157*a,* 157*b* for the purpose of avoiding contact with the child and thereby causing discomfort.

The securing member 115 of the presently preferred embodiment will now be further described with reference to FIGS. 5, 8, 9, 10, and 11.

Referring to FIGS. 8 and 9, a substantial portion of securing member 115 is disposed on the rear face 30 of the supporting surface 15. The securing member 115 includes a strap or webbing 200 which is fixed to the rear face 30 of the supporting surface 15 to thereby fixedly attach the securing member 115 to the rear face 30. The webbing 200 is fixed to the rear face between the apertures 19*a* and 19*b* of the supporting surface 15 by fabric stitching 207 (as shown in FIGS. 9, 10 and 11). The webbing 200 of the securing member 115 includes left and right fastening ends, 205*a* and 205*b,* respectively. Attached at the ends of the left and right fastening ends 205*a,* 205*b* are right and left female fasteners 124*a* and 124*b,* respectively. The fastening ends 205*a,* 205*b* extend through the apertures 19*a* and 19*b* of the supporting surface 15. When the removable pad 40 is being attached to the front face 20, the apertures 50*a,* 50*b* of pad 40 provide a passageway for the female fasteners 124*a,* 124*b* so that the female fasteners are disposed on the seating side and in position for engagement with the male fasteners 120*a,* 120*b* attached to the supporting member 110 (as shown in FIGS. 10–11).

As mentioned earlier, apertures 50*a,* 50*b* of the pad 40 are slightly oversized so that the fastening ends 205*a,* 205*b,* can be easily pulled through or inserted into the apertures 50*a,* 50*b* as the pad 40 is removed or attached, respectively, to the supporting surface 15. As discussed in more detail below, the portion of the fastening ends 205*a,* 205*b* disposed on the seating side will vary depending on the desired waist size for the harness.

The harness adjustment feature of the presently preferred embodiment will now be described with reference to FIGS. 5, 8–11.

The securing member 115 includes an adjustment means for adjusting the waist size of the harness 110. In the preferred embodiment, the webbing 200 of securing member 115 includes a center portion 210 and fastening ends 205*a*, 205*b*, these fastening ends correspond to the right and left end portions of webbing 200. Referring to FIG. 3, the center portion 210 includes a fixed part 212 (which includes that portion of the webbing 200 stitched the rear face 30 of the supporting surface 15, FIG. 9) and a right and left adjustment parts 214*b*, 214*a* disposed between the fixed part 212 and the right fastening end 205*b* and left fastening end 205*a*, respectively. The right and left adjustment parts 214*b*, 214*a* of the center portion 210 include a portion of the webbing 200 folded over and secured in a folded position by stitching 224*a*, 224*b*. Right and left first fasteners 220*b*, 220*a* are disposed on the adjustment parts 214*b*, 214*a* (as shown in FIGS. 2, 10 and 11) and are preferably of a loop-type fastener. A plurality of right and left second fasteners 222 are disposed on the fixed part 212 for engagement with the right and left first fasteners 220*a*, 220*b*. These plurality of right and left second fasteners 222 are preferably formed by attaching a lengthwise strip of hook-type fasteners on the fixed part 212. It is understood that any other suitable pairs of fasteners can be used in placed of these hook and loop fastener pairs. For example, the first fastener can be one of a male and female snap and the plurality of second fasteners can be a lengthwise series of the other type of male and female snaps. The first and second pairs of the fasteners could also take the form of D-rings attached to the adjustment parts 214*b*, 214*a* that are releasably securable to a plurality of hooks positioned on the fixed part 212.

The harness size is adjustable by shortening or lengthening the portion of the fastening ends 205*a*, 205*b* disposed on the seating side. As shown in FIGS. 10 and 11, the spacing between the adjustment parts 214*a*, 214*b* secured to the center part 212 determines the harness size. When the adjustment parts 214*a*, 214*b* are spaced further apart, the lengths of the fastening ends 205*a*, 205*b* is increased (as indicated in FIG. 10 by length $L_1$). Similarly, when the adjustment portions 214*a*, 214*b* are brought closer together, the lengths of the fastening ends 205*a*, 205*b* are shortened (as indicated in FIG. 11 by length $L_2$). The lengths $L_1$ and $L_2$ of the fastening ends 205*a*, 205*b* correspond to a first harness size 130 and second harness size 135, respectively. As can be seen in FIGS. 10 and 11, the lengthwise strip of second fasteners 222 provides a plurality of second fasteners for attaching the first fasteners 220*a*, 220*b* at a plurality of positions, thereby providing a plurality of harness sizes.

Figure 5:
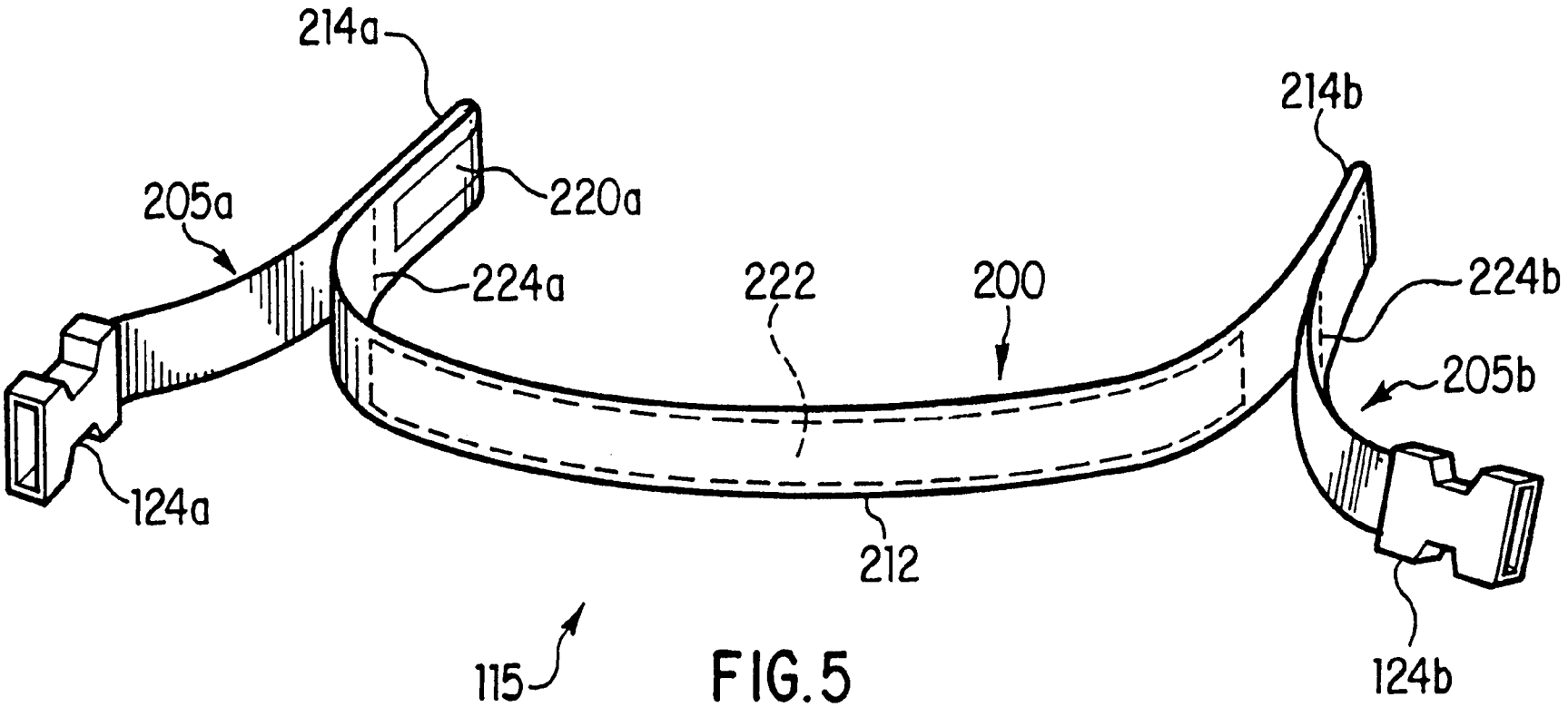
FIG. 5 is an isometric view of a portion of the harness in FIG. 1*a*.

As is apparent by viewing FIGS. 5, 10 or 11, the harness size is re-positionable by simply lifting the adjustment portions away from the fixed part of the webbing (thereby disengaging the first and second fasteners), moving the adjustment portions closer or further apart to accomodate a decreased or increased waistsize, respectively, and then re-securing the adjustment portions to fasteners located adjacent the adjustment portions' new position.

Any of the features of the invention disclosed can be used separately, or can be combined and used together.

It will be apparent to those skilled in the art that various modifications and variations can be made in the harness of the present invention without departing from the scope or spirit of the invention. For example, the harness is not limited to a child carrier per se, but can also include a stationary seat or bed where it is desirable to restrain the motion of a child. The supporting structure, preferably providing both a waistline and crotch support, could simply be a waistline support. The removable pad, preferrably covering the entire supporting surface, could alternatively cover only a portion of the supporting surface or be removed altogether. In this case, the supporting structure could be directly fastened to the front face of the supporting surface. Thus, it is intended that the present invention covers the modifications and variations of this invention provided they come within the scope of the appended claims and their equivalents.

What is claimed is:

1. A harness for restraining a child in a child carrier, the child carrier including a support surface having a front face and a rear face, comprising:

a first member disposed entirely on the front face and being removably attachable to the front face, and a second member disposed substantially on and secured to the rear face and including a pair of first member engagement ends disposed on the front face, wherein said second member is releasably engageable with said first member for restraining the child in the child carrier by engaging said first member engagement ends with said first member, and wherein said first member is removable from the front face without removal of said second member from the rear face.

2. The harness of claim 1, wherein said first member includes a pad secured to the first member, said pad including a pad fastener securing said pad to the front face, wherein said first member is removable from the front face by disengaging said pad fastener from the front face.

3. The harness of claim 2, wherein said first member further includes an upper soft goods portion positioned between a first pair of fasteners and proximate to the waist of the child occupant, said first pair of fasteners releasably engageable with a second pair of fasteners attached to said second member, and a lower tapered soft goods portion forming a crotch strap, integral with said upper soft goods portion at an upper end and being fixable to said pad.

4. A harness for restraining a child in a child carrier, the child carrier including a supporting surface with a front face and rear face, comprising:

a first member being removably attachable to the front face, a second member being fixable to the rear face, said second member further including first and second fastening ends disposable adjacent to the supporting surface, said first and second fastening ends including fasteners for releasably attaching said first and second members, and an adjustment means disposable on the rear face for increasing and reducing the harness size by lengthening and shortening, respectively, said fastening ends, wherein said second member is releasably engageable with said first member for restraining said child in the child carrier.

5. A harness for restraining a child in a child carrier, the child carrier including a supporting surface with a front face and rear face, comprising:

a first member being removably attachable to the front face, and a second member being fixable to the rear face, the second member including a strap comprising:

first and second fastening ends disposable adjacent the supporting surface, said first and second fastening ends including fasteners for releasably attaching said first and second members, and a center portion disposable on the rear face, said second member being fixable to the rear face by attaching said center portion to the rear face, wherein said center portion includes an adjustment means for adjusting the size of the harness by adjusting the length of the fastening ends, wherein said second member is releasably engageable with said first member for restraining the child in the child carrier.

6. The harness of claim 5, wherein said adjustment means includes right and left first strap length fasteners and a plurality of right and left second strap length fasteners disposed on said center portion for adjusting the length of said first and second fastening ends, said length of said fastening ends being adjustable by re-positioning said pair of right and left first strap length fasteners on said plurality of right and left second strap length fasteners.

7. The harness of claim 6, wherein said adjustment means further comprises:

a fixed part, first and second adjustment parts disposed between said fixed part and said first and second fastening ends, respectively, said plurality of right and left second strap length fasteners being disposed on said fixed part, and said right and left first strap length fasteners being disposed on said first and second adjustment parts, respectively, said first and second adjustment parts being movably positionable with respect to said fixed part to shorten and lengthen the length of said first and second fastening ends by positioning said first and second adjustment parts closer and farther away from each other, respectively, and said first and second adjustment parts being secured closer and farther away from each other by securing said right and left first strap length fasteners to a right and left second strap length fastener located adjacent to said right and left first strap fastener, respectively.

8. The harness of claim 7, wherein one of said first and second strap length fasteners corresponds to one of a loop and hook fastener and the other of said first and second strap length fasteners corresponds to the other of a loop and hook fastener.

9. The harness of claim 8, wherein said plurality of right and left second strap length fasteners is a lengthwise strip of hook type fasteners and said right and left first strap length fasteners are loop type fasteners, said right and left first strap length fasteners being freely positionable along the length of said lengthwise strip of hook type fasteners.

10. An apparatus for adjusting a harness, the harness including a supporting member, and a securing member, the securing member including a strap, comprising:

an adjustable length fastening end at each opposite end of the strap, the length of said adjustable length fastening ends being proportional to a harness size, said adjustable length fastening ends including a pair of fasteners for fastening said securing member to said supporting member, and a center portion of said strap being disposed between said adjustable length fastening ends, said center portion including a fixed part and right and left adjustment parts, said right and left adjustment parts being movable between at least an adjacent and distal position relative to each other corresponding to a decreased and increased length, respectively, of said adjustable length fastening ends, wherein the harness is adjustable between a first harness size and a second harness size by securing said right and left adjustment parts in said distal and adjacent positions, respectively.

11. A method for releasably securing a child in a child carrier, the child carrier including a supporting surface including a front face and rear face, comprising:

securing a first harness member to a removable pad, said removable pad being releasably securable to the front face, disposing a second harness member substantially on the rear face, the second harness member being fixedly securable to the rear face and including fastening ends being disposable on the front face, adjusting the harness midsection size by adjusting said fastening ends, and coupling said first and second harness members with said fastening ends to secure the child in the child carrier.

12. A child carrier, comprising:

a supporting surface, said supporting surface including a seating side with a removable pad disposed thereon and a rear face, a harness, said harness including first and second harness members, said first harness member being fixed to said removable pad and said second harness member being fixed to said rear face, fastening means for releasably engaging said first and second harness members, wherein a child is releasably securable in said seat by releasably engaging said first and second harness members.

13. The child carrier of claim 12, wherein said fastening means for releasably engaging said first and second harness members is disposed on the seating side.

14. The child carrier of claim 12, wherein said second harness member further includes a harness adjustment means disposed on the rear face.

15. The child carrier of claim 12, wherein said removable pad disposed on the seating side of the supporting surface covers a substantial portion of the supporting surface.

16. A harness for restraining a child in a child carrier, the child carrier including a support surface having a front face and a rear face, the support surface providing body support for the child in the child carrier, said harness comprising:

a securing member secured to the rear face, and a supporting member securable to the front face, wherein said supporting member is releasably engageable with said securing member for restraining the child in the child carrier and said supporting member is removable from the front face without removing said securing member from the rear face, and wherein said securing member is disposed substantially on the rear face and said supporting member is disposed entirely on the front face.

17. The harness of claim 16, wherein said supporting member includes a pad secured to said supporting member, said pad including a pad fastener securing said pad to said front face, wherein said supporting member is removable from said front face by disengaging said pad fastener from said front face.

18. The harness of claim 16, wherein said securing member includes a central portion fixed to said rear face and first and second fastening ends disposed on said front face for releasable engagement with said supporting member.

19. The harness of claim 18, wherein said central portion is stitched to the rear face.

20. The harness of claim 16, wherein said securing member is a webbing fixed to said rear face at a central portion thereof with first and second distal webbing ends being disposed on said front face.

21. The harness of claim 16, wherein said securing member further includes a harness adjustment disposed entirely on the rear face, said harness adjustment being adapted for selectively adjusting the harness size prior to engagement of said supporting member and said securing member.

* * * * *